United States Patent [19]

Brandell

[11] Patent Number: 4,681,317

[45] Date of Patent: Jul. 21, 1987

[54] GOLF EXERCISE DEVICE

[76] Inventor: John R. Brandell, 427 Shore Line Rd., Barrington, Ill. 60015

[21] Appl. No.: 733,592

[22] Filed: May 10, 1985

[51] Int. Cl.[4] ..... A63B 21/02

[52] U.S. Cl. ..... 272/137; 272/143; 273/84 R

[58] Field of Search ..... 272/137, 142, 143, 75, 272/76, 135, 136; 273/84 R, 29 A, 35 R, 193 A, 84 A

[56] References Cited

U.S. PATENT DOCUMENTS

| | | | |
|---|---|---|---|
| 765,605 | 7/1904 | Wade | 273/84 R |
| 3,312,466 | 4/1967 | Melchiona | 272/137 |
| 3,454,274 | 7/1969 | Kaneshiro | 272/135 X |
| 3,462,156 | 8/1969 | Gentry | 272/135 X |
| 3,822,061 | 7/1974 | Sigma | 272/137 |
| 4,023,803 | 5/1977 | Lewis | 273/84 A |
| 4,328,964 | 5/1982 | Walls | 272/143 X |

FOREIGN PATENT DOCUMENTS

| | | | |
|---|---|---|---|
| 2218336 | 11/1972 | Fed. Rep. of Germany | 272/137 |
| 26028 | of 1908 | United Kingdom | 272/75 |

*Primary Examiner*—Richard I. Apley
*Assistant Examiner*—J. Welsh
*Attorney, Agent, or Firm*—Emrich & Dithmar

[57] ABSTRACT

An exercising device includes a pair of elongated handle members each having an end portion and a gripping portion, with the end portions having an attached rotatable spinner member. A resilient elastic member interconnects the spinner members together and provides a maximum force against the relative movement of the handle members with respect to each other to provide an isokinetic exercise device.

19 Claims, 11 Drawing Figures

GOLF EXERCISE DEVICE

BACKGROUND OF THE INVENTION

The present invention relates to a novel exercise device and, more particularly, to a novel exercising device designed to develop hand and arm muscles that are used extensively playing games, such as, golf, baseball, softball, tennis, bowling or the like.

Devices for exercising various muscles of the body have been suggested in the prior art. See, for example, U.S. Pats. Nos. 113,384, 1,123,272, 1,539,569, 3,807,730. Such devices, generally including a pair of handles interconnected together by springs or other type resilient member, permit the user to develop forearm and chest muscles through a limited range of movements and exercises. However, such exercise devices have limited usefulness because they do not provide the same level of resistance through the entire range of motion during usage of such exercise device. Thus, such devices only permit the user to experience isotonic muscle development through a limited range of movement. Additionally, such devices do not include handle or hand engaging members, which correspond to the gripping member actually utilized in the particular intended sport and, accordingly, do not provide any exercise for development of the hand and forearm muscles necessary to compete in such sports.

To overcome the difficulty of the above described prior art exercise devices, it has been suggested in U.S. Pats. Nos. 2,848,234, 3,618,942 and 4,328,964 to utilize a single handle attached by some type of resilient means to a fixed wall structure. Such attachment to a fixed stationary object is designed to permit the user of such devices to exercise muscles through a limited range of movement. Again, such exercise devices only provide isotonic exercise results because they do not provide the same difficulty of resistance through the entire range of motion. Therefore, such devices provide only limited development of muscles.

SUMMARY OF THE INVENTION

It is one object of the present invention to provide a novel exercise device having a pair of elongated handles interconnected together at the ends thereof by a resilient elastic member.

A further object of the present invention is to provide a novel exercise device comprising a pair of elongated handles having a gripping protion thereon, with the handles interconnected together at the ends thereof to spinner members which are freely rotatable on the ends of the handles to provide an isokinetic exercise device which provides maximum stress or resistance to muscle exercises through the entire range of movement of the exercise device.

Still another object of the present invention to provide a pair of elongated handle members interconnected together by resilient members such as springs, rubber or elastic members which permits the ready attachment of varying strengths of the elastic members to provide a variable isokinetic exercise device.

Still another object of the present invention to provide a unique and novel exercise device which permits the exercise of muscle and hand movements through a universal range of movements.

Another object of the present invention is to provide an exercise device which is portable and may be used by the user when in sitting or standing positions to strengthen the hands and muscles necessary in playing athletic sports such as golf, tennis, baseball and bowling.

Still another object of the present invention is to provide isokinetic exercise device which is simple in construction and inexpensive to manufacture and which provides a maximum resistance during exercising hand and forearm muscles through the whole range of exercise movements.

The present invention provides an exercise device which is inexpensive and capable of rapid an simple usage and which permits an isokinetic exercise in that the maximum resistance is provided by the device for the hands and forearm muscles through the entire range of movements of the user of the device. Importantly, the pair of handle members of the present exercise device are particularly designed to accommodate and to provide the structure and feel, for example, of the gripping portion of a golf club. Such sizing and structure of the handles, having the golf club grip provides the user of the novel exercise device in accordance with the present invention with exercise movement and stresses which a golfer would actually encounter while playing golf. Thus, the present invention provides a novel exercise device which ideally reproduces the grip and the feel of the golf clubs and the stresses encountered in playing golf, or any sport such as baseball, tennis or the like, and provides for the development of the wrist and forearm muscles that are necessary to provide the proper physical conditioning necessary in playing such sports.

Accordingly, if it is desired to utilize the present exercise device in strengthening the hands for playing tennis or batting a ball, the handle portion of the exercise device may be provided to include a hand gripping portion which represents the handle of a tennis racket or the gripping end of a bat. Because of the feature of utilizing a resilient or elastic member or means to interconnect the ends of the two handles together, the exercise device permits the user thereof to rotate the handles and stengthen the wrist and finger muscles as well as the forearms during conditioning movements, and provides an exercising device which incorporates a constant resistance between the two handles to provide an isokinetic exercise device through an unlimited range of movement of the handles with respect to one another.

The foregoing as well as other features and advantages of the present invention are more clearly understood by the following detailed description which when considered together with the drawings which, by way of example, illustrate several forms of the present exercise device.

DETAILED DESCRIPTION

Figure 2:
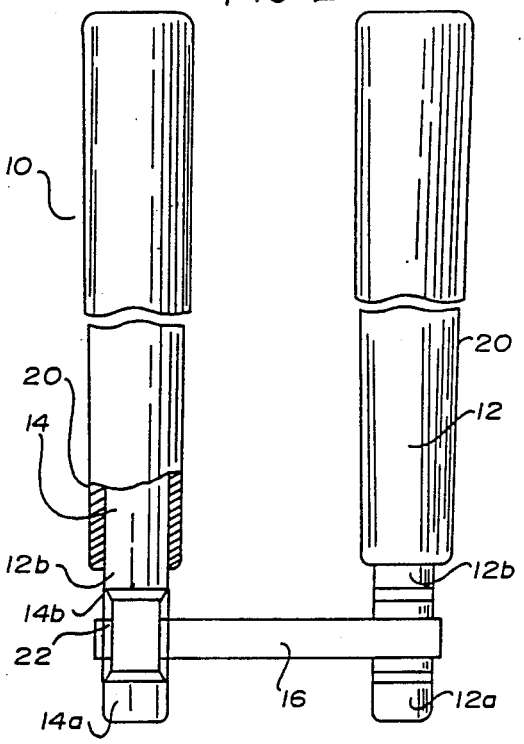
FIG. 2 is a side elevational view of one embodiment of the exercise device in accordance with the present invention with parts broken away and parts taken in section.

Referring now to the drawings wherein like numerals have been used throughout the several views to describe the same or similar parts, in FIG. 2 the exercise device or apparatus 10 in accordance with the present invention includes a pair of elongated poles or handle members 12 and 14, having ends 12*a* and 14*a* thereon, which are attached together at the ends 12*a* or 14*a* or adjacent the ends 12*a* and 14*a* by a resilient elastic, rubber, spring member or means 16. The resilient elastic or spring means 16 may be a band of endless rubber or synthetic elastic material or may be a conventional spring member possessing a predetermined force for innerconnecting the ends of the two handles 12 and 14 to provide a maximum resistance through an unlimited range of movements of the pair of handles 12 and 14 with respect to one another during usage of the exercise device or apparatus 10.

Figure 10:
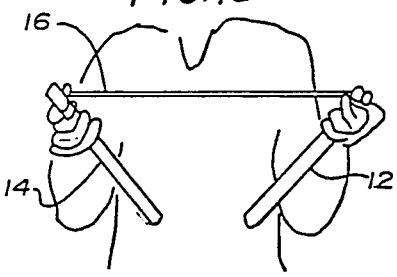
FIG. 10 is a front view illustrating one method of utilizing the exercise device in accordance with the present invention.
Figure 11:
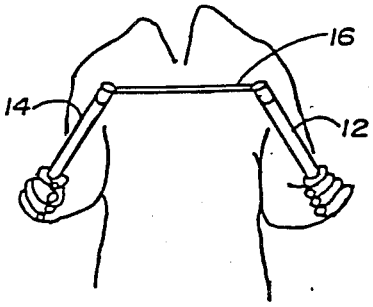
FIG. 11 is a front view illustrating another method of utilizing the exercise device in accordance with the present invention.

Preferably, the handles 12 and 14 are comprised of a elongated metallic tube 12*b* approximately 12 inches in length upon which a conventional golf grip 20, of approximately 8–11 inches in length, is securely mounted, as is well known in the art. The golf grip 20 may be comprised of rubber, plastic, or leather to provide the hand engaging portion or the grip portion of the handles 12 and 14. The substantial length of the hand engaging or gripping portion 20 permits the user of the present invention to vary the resistance of the resilient member 16 by engaging the grip portion adjacent the area where the resilient member is secured to the handle (FIG. 10) or adjacent the oher end of the handle, as shown in FIG. 11, or any position for varying the degree of resistance of the resilient member. However, the handles 12 and 14 may be comprised of an elongated rod composed of metal, wood, plastic and the like. As shown in FIG. 2, the resilient elastic, rubber or spring means 16 is attached to the ends 12*a* and 14*a* of the handles 12 and 14, respectively. Generally, it is preferred that the resilient elastic or rubber means 16 is of endless construction and is attached to the end 12*a* by securing or attaching the means 16 to the end 12*a*. As shown in FIG. 2, the handle 12 represents the simplest construction of the disclosed exercise device 10 wherein both of the handles 12 and 14 may be of the construction of handle 12 wherein the elastic or rubber means 16 is attached directly to the end 12*a*. However, the embodiment of the present invention, as shown in FIG. 2, further illustrates on handle 14 a sleeve bearing 22 which may be rotationally mounted about a recess 14*b* adjacent the end 14*a* of handle 14, with the elastic or rubber means 16 firmly secured to the sleeve bearing 22. Thus, during usage of such an exercise device, the sleeve bearing 22 rotates and permits universal movement of the pair of handles 12 and 14 with respect to each other and provides a range of movements of the handles 12 and 14 without the elastic or rubber means 16 binding upon the ends 12*a* or 14*a* thereof during usage of the exercise device 10. Additionally, the present disclosed exercise device 10 includes a pair of hand receiving or gripping portions 20 mounted thereon with the ends of the handles 12 and 14 adapted to be interconnected with a resilient elastic or spring member means 20 to complete the exercise device 10. If desired, the handles 12 and 14 may be fitted wtih a gripping portion simulating a handle of a tennis racket or simulating a bat handle, the structures of which are well known in the art.

Figure 1:
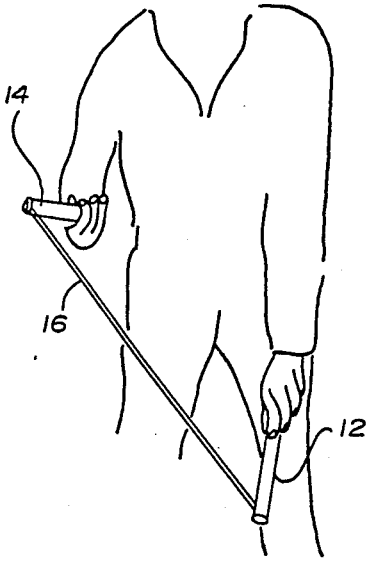
FIG. 1 is a front view illustrating one manner of utilizing the exercise device in accordance with the present invention.
Figure 4:
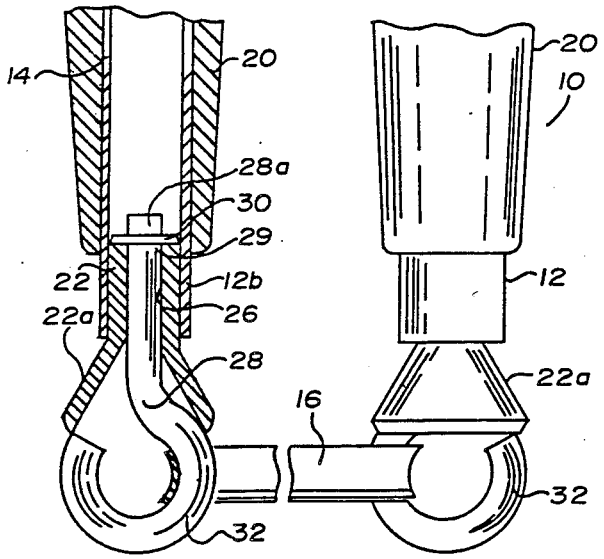
FIG. 4 is a fragmentary side elevational view of a further embodiment of the exercise device in accordance with the present invention with parts broken away and parts taken in section.
Figure 3:
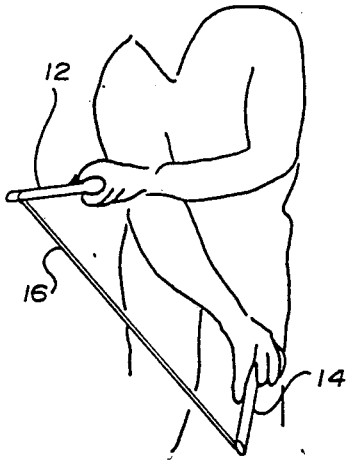
FIG. 3 is a front view illustrating another manner of utilizating the exercise device in accordance with the present invention.
Figure 5:
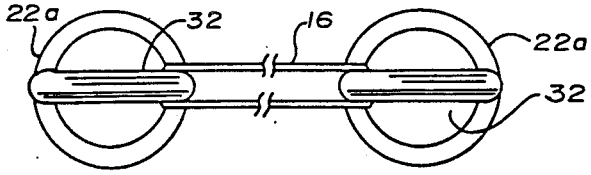
FIG. 5 is a top plan view of the embodiment of the exercise device shown in FIG. 4.

FIG. 4 illustrates a further embodiment of the exercise device or apparatus 10 in accordance with the present invention which includes a pair of elongated tubular handles 12 and 14 having ends 12*a* and 14*a* thereon. Mounted within each of the ends 12*a* and 14*a* of the tubular handles 12 and 14 is a sleeve-bearing 22 which is adapted to be sized and received by the tubular ends 14*a*. The sleeve-bearing may be sealed within the tubular end 14*a* by an adhesive or the sleeve-bearing 22 may include an annular groove 24 therein which permits the tube end 14*a* to be crimped therearound to firmly retain the sleeve-bearing 22 within the end 14*a* of the elongated handle tube 14, as will hereinafter be described. In the embodiment of the exercise device shown in FIGS. 4 and 5, the sleeve-bearing 22 includes a portion 22*a* which is flared outwardly and a center opening 26 therein which is adapted to receive a spinner member or hook means 28 therein. As shown in the left portion of FIG. 4, the end 28*a* of the spinner member includes an annular recess 29 therein which recess is adapted to receive a locking washer 30 to firmly retain the spinner member 28 within the sleeve opening 26 of the bearing member 22 and which permits the spinner member 18 to freely rotate thereon. The spinner member 28 includes a hook portion 32 thereon which is adapted to receive and hold the resilient elastic or spring means 16 therein. As shown in FIGS. 4 ad 5, the resilient elastic member 16 is an endless rubber band 16 which is anchored to the hook portion 32 of the hook member 28 to interconnect the ends 12*a* and 14*a* of the exercise device or apparatus 10 together. Also, the handle members 12 and 14 include a gripping portion 20 extending substantially the length thereof, as has been previously described. The substantial length of the hand engaging or gripping portion 20 permits the user of the present invention to vary the resistance of the resilient member 16 by engaging the grip portion adjacent the area where the resilient member is secured to the handle (FIG. 10) or adjacent the oher end of the handle, as shown in FIG. 11, or any position for varying the degree of resistance of the resilient member. When the handle members 12 and 14 are moved apart from each other during exercising, the resilient rubber endless band 16 applies a maximum force against the movement of the pair of handle members with respect to each other during such exercising movements. Such exercising movements are shown in FIGS. 1 and 3 and illustrate the movement of the pair of handles 12 and 14 with respect to one another to strengthen the wrist and forearms of the user and which provides through a whole range of movement a maximum resistance or force against the movement of the pair of handles 12 and 14 away from one another.

Figure 7:
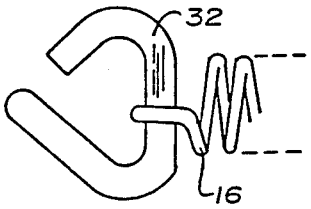
FIG. 7 is a fragmentary top view of the embodiment of the exercise device shown in FIG. 6.
Figure 6:
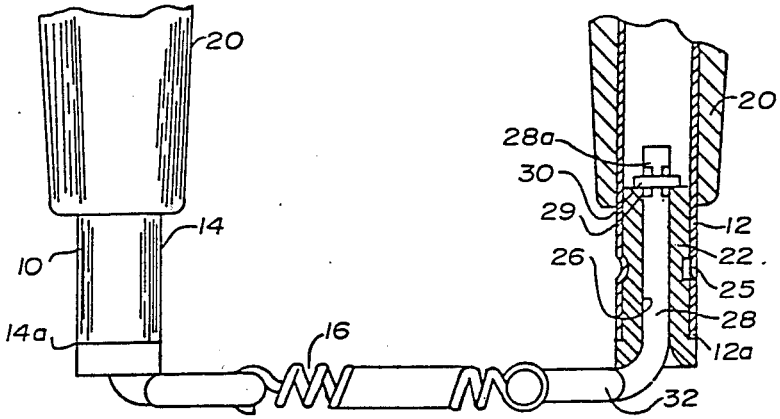
FIG. 6 is a fragmentary side elevational view of another embodiment of the exercise device in accordance with the present invention with parts broken away and parts taken in section.

FIGS. 6 and 7 further describe a further embodiment of the present invention wherein the exercise device 10 includes a pair of tubular metal handles or tubes 12 and 14 having ends 12*a* and 14*b* thereon. A sleeve-bearing 22 is provided and is adapted to be received within the metallic tube ends 12*a* and 14*a*. The sleeve-bearing 22 includes an annular groove 24 therearound such that when the sleeve-bearing is positioned within the ends of the metallic tubes 12 and 14, the sides of the tubes 12 and 14 may be crimped (as shown at 25) to firmly retain and mount the sleeve-bearing within the end of the tubes. In this disclosed embodiment, an L-shaped hook member 28 is adapted to be received within the center opening 26 of the sleeve-bearing 22. The L-shaped hook member 28 includes an annular groove 29 at the end 28*a* thereof which is adapted to receive a locking washer 30 to firmly retain the L-shaped hook member 28 within the sleeve-bearing 28 and permit L-shaped hook member 28 to freely thereon. The hook member 28 includes also a hook portion 32 (best shown in FIG. 7), to which is attached a resilient spring member 16 to innerconnect the ends 12*a* and 14*a* of the exercise device 10 together. The spring member 16 applies a maximum force against the movement of the pair of handle members away from each other during exercising and provides a maximum resistance or force to the muscles through a universal range of movement of the pair of handles 12 and 14 with respect to one another, as illustrated in FIGS. 1, 3 and 10–11.

Figure 9:
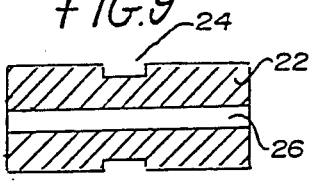
FIG. 9 is a cross-sectional view of the sleeve bushing utilized in attaching the spinner member to the pole section in accordance with the present invention.
Figure 8:
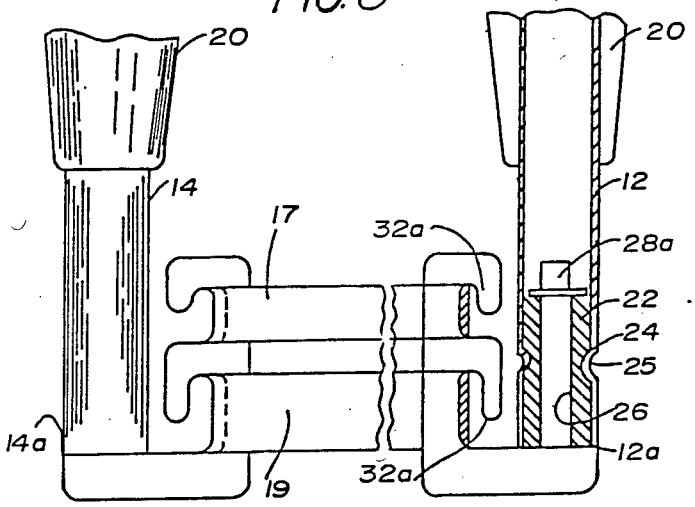
FIG. 8 is a fragmentary side elevational view of another embodiment of the exercise device in accordance with the present invention with parts broken away and parts taken in section.

FIG. 8 illustrates a preferred embodiment of the present invention wherein the exercise device 10 includes a pair of elongated metal tubular handles 12 and 14 having ends 12*a* and 14*b* thereon. A sleeve-bearing member 22 is provided and adapted to be received within the metallic tubular ends 12*a* and 14*a* and includes an annular groove 24 therearound, best shown in FIG. 9. When the sleeve-bearing 22 is positioned within the ends of the metal tubes 12 and 14, the sides of the tubes are crimped into the annular groove 24 to firmly retain the sleeve-bearing within the ends of the tubes, as shown at 25 in the right portion of FIG. 8. The hook or spinner member 28 is adapted to be received within the center opening 26 of the sleeve-bearing 22 and the hook member 28 includes an annular groove 29 at the end 28*a* thereof which is adapted to receive a locking washer 30 to firmly retain the spinner member 28 within the sleeve-bearing and to permit rotation thereof on therearound the end of the tubes. The spinner member 28, preferably, includes a plurality of hook portions 32*a* thereon to which are attached the resilient endless elastic member 16 to interconnect the ends 12*a* and 14*b* of the exercise device 10 together when. As shown in FIG. 8, the elastic band 17 is adapted to be received and retained by hook portions 32*a* and represents, for example, a ten pound test weight for applying a ten pound force against the movement of the pair of handles away from each other during exercising movements. Such a strength of the resilient endless rubber band may be used by women exercisers utilizing the exercise device 10 in accordance with the present invention. Endless rubber band member 19 represents a heavier duty endless band which may possess, for example, a 20 pound force and such a band could well be used by men utilizing the exercise device 10 in accordance with the present invention. It is within the scope of the present invention to utilize both the light-weight band 17 in combination with the heavier duty band 19, and the resultant structure, as shown in FIG. 8, is an exercise device 10 having a combination of variable strength resilient elastic or spring means 16 innerconnecting the ends of the exercise device together. When such variable strength resilient or rubber members are utilized to apply an increased force against the relative movement of a pair of handle members with respect to each other an entire range of movement of the handles 12*a* and 14*a* of the device with respect to one another is possible with varied resistive forces, as shown in FIGS. 1, 3, and 10–11.

The novel hook or spinner member 28 in accordance with the present invention may be comprised of a die cast metal or alloy or may be comprised of a hard plastic material, such as Lexan, a polymer material which possesses the necessary strength and rigidity to withstand the forces exerted by the elastic or spring members 16 during exercising movements. The spinner member permits also the continuous alignment of the stretched elastic or resilient member 16 between the ends during movement of the pair of handles 12 and 14 with respect to one another.

It is readily apparent that the exercise device or apparatus in accordance with the present invention has particular application in exercising and developing the muscles of the hands and arms used in various sports such as golf, tennis, baseball, bowling or the like. The device may be used by the user in a seating position or in a standing position wherein the hands, wrists and forearms of the user may be moved through the entire range of movement necessary for participating in a particular sport to develop the particular muscles necessary to properly engage in the sport.

The present disclosed exercise device, as included in particular forms of exercise devices which have been described and discussed hereinabove, may include modifications without departing from the scope and spirit of the present invention.

I claim:

1. An exercising device comprising:

a pair of elongated tubular handle members each having an end portion and a gripping portion extending substantially the length of said elongated tubular handle members opposite said end portions, with each of said end portions providing a tubular shaft, wherein at least one of said end portions of said pair of tubular handle members includes a sleeve-bearing mounted within said tubular shaft to provide an axis of rotation thereon and a spinner member rotatably secured on said said sleeve-bearing, with said spinner member including a shaft portion rotatably secured to said sleeve-bearing and a hook portion positioned outside the outer surface of the tubular handle member, and resilient means secured to one of said end portions and to said hook portion of said spinner member and interconnecting together said ends of said pair of handle members, with said resilient means applying a variable resistance against the reactive universal movement of the pair of handle members with respect to each other.

2. The exercising device in accordance with claim 1, wherein said gripping portion is configured to provide the grip of a golf club.

3. The exercising device in accordance with claim 1, wherein said gripping portion is configured to provide the grip of a bat.

4. The exercising device in accordance with claim 1, wherein said gripping portion is configured to provide the grip of a tennis racket.

5. The exercise device in accordance with claim 1, wherein said resilient means is an endless band of rubber material.

6. The exercise device in accordance with claim 1, wherein said resilient means is a metal spring member.

7. The exercise device in accordance with claim 1, wherein said spinner member is substantially L-shaped and said hook portion of said spinner member is positioned at least substantially perpendicular to the axis of rotation of said shaft portion of said spinner member.

8. The exercise device in accordance with claim 1, wherein said hook portion of said spinner member is positioned substantially parallel to the axis of rotation of said shaft portion of said spinner member.

9. An exercising device comprising:

a pair of elongated tubular handle members each having end portions and a gripping portion positioned on said elongated handle members opposite said end portions, with each of said end portions providing a tubular shaft, bearing means having a central opening therein, said bearing means being fixedly mounted within each of said tubular end portions of said handle members to provide an axis of rotation, a spinner member rotatably secured within said central opening in each of said bearing means, with said spinner member including a shaft portion rotatably secured to said bearing means and a hook portion positioned outside the outer surface of the tubular handle member and resilient means secured to said spinner members and interconnecting together said pair of handle members, with said resilient means applying a variable resistance against the relative universal movement of the pair of handle members with respect to each other.

10. The exercise device in accordance with claim 9, wherein said hook portion of said spinner member is positioned substantially parallel to the axis of rotation of said shaft portion.

11. The exercise device in accordance with claim 10, wherein said resilient means is comprised of a plurality of elastic members engageable with said hook portion of said spinner member to provide a variable resistance against the relative universal movement of the pair of handle members with respect to each other.

12. The exercise device in accordance with claim 9, wherein said spinner member is substantially L-shaped and said hook portion is positioned substantially perpendicular to the axis of rotation of said shaft portion.

13. The exercising device in accordance with claim 9, wherein said gripping portion is configured to provide the grip of a golf club.

14. The exercising device in accordance with claim 9, wherein said gripping portion is configured to provide the grip of a bat.

15. The exercising device in accordance with claim 9, wherein said gripping portion is configured to provide the grip of a tennis racket.

16. The exercising device in accordance with claim 9, wherein said resilient means is an endless band of rubber material.

17. The exercising device in accordance with claim 9, wherein said resilient means is a metal spring member.

18. The exercise device in accordance with claim 9, wherein said bearing means is fixedly secured to said end portions by an adhesive.

19. The exercise device in accordance with claim 9, wherein said bearing means includes an annular groove therearound and said bearing means is fixedly secured to said end portions by crimping a portion of said tubular handle members into said annular groove to secure said bearing means to said handle members.

* * * * *

UNITED STATES PATENT AND TRADEMARK OFFICE

CERTIFICATE OF CORRECTION

PATENT NO. : 4,681,317

DATED : July 21, 1987

INVENTOR(S) : John R. Brandell

It is certified that error appears in the above—identified patent and that said Letters Patent is hereby corrected as shown below:

Column 6, line 63, "reactive" should be --relative--.

Signed and Sealed this

Fifteenth Day of December, 1987

*Attest:*

DONALD J. QUIGG

*Attesting Officer*

*Commissioner of Patents and Trademarks*